US005995047A

United States Patent [19]

Freyssinier et al.

[11] Patent Number: 5,995,047

[45] Date of Patent: Nov. 30, 1999

[54] MICROSTRIP ANTENNA DEVICE, IN PARTICULAR FOR TELEPHONE TRANSMISSIONS BY SATELLITE

[75] Inventors: Philippe Freyssinier, Noisy le Roi; Joël Medard, Meudon, both of France

[73] Assignee: Dassault Electronique, Saint-Cloud, France

[21] Appl. No.: 08/804,881

[22] Filed: Feb. 24, 1997

Related U.S. Application Data

[63] Continuation of application No. 07/971,206, Nov. 4, 1992, abandoned.

[30] Foreign Application Priority Data

Nov. 14, 1991 [FR] France ..... 91 13984

[51] Int. Cl.[6] ..... H01Q 1/38

[52] U.S. Cl. ..... 343/700 MS; 343/846

[58] Field of Search ..... 343/700 MS, 846, 343/829, 848, 830; H01Q 1/38

[56] References Cited

U.S. PATENT DOCUMENTS 4,792,810 12/1988 Fukuzawa et al. ..... 343/700 MS
5,010,348 4/1991 Rene et al. ..... 343/700 MS
5,497,164 3/1996 Croq ..... 343/700 MS
5,539,420 7/1996 Dusseux et al. ..... 343/700 MS
5,621,571 4/1997 Bantli et al. ..... 343/700 MS

*Primary Examiner*—Hoanganh Le
*Attorney, Agent, or Firm*—Nixon & Vanderhye P.C.

[57] ABSTRACT

An improved microstrip antenna device, in particular for telephone transmissions by satellite. An antenna comprises a first dielectric layer including on one side a ground plane and on the other a first conductive patch of a chosen shape, a second dielectric lalyer surmounts the first dielectrica layer on the side adjacent to the first patch and supports, on the other side remote from the first patch, a second cnoductive patch of a chosen shape. A third dielectric layer surmounts the second. The second patch is of a size smaller than that of the first patch and this first patch is fed from below at at least one chosen point situated between its center and its circumference. Advantageously, the first patch is connected to a lead-in of the ground plane joining a feeding circuit implanted in a dielectric substrate of a three-plate structure.

31 Claims, 5 Drawing Sheets

MICROSTRIP ANTENNA DEVICE, IN PARTICULAR FOR TELEPHONE TRANSMISSIONS BY SATELLITE

This application is a continuation of application Ser. No. 07/971,206, filed Nov. 4, 1992, abandoned.

FIELD OF THE INVENTION

The invention concerns microstrip antenna devices.

PRIOR ART

Many antenna structures have already been described in this field. The simplest microstrip radiating structure includes a dielectric layer carrying on one side a conductive patch of a chosen shape and on the other side, a conductive plane called a ground plane. To obtain an antenna, it is necessary to define the mode of feeding this structure with ultra-high frequency energy.

The idea of providing a stack of superposed patches has already been described in LONG & WALTON's article "A dual frequency stacked circular disc antenna", IEEE Transactions on Antennas and Propagation, Vol. AF 27, No. 2, March 1979. Other proposals have since been formulated.

As regards the feeding of superposed two-patch antennas, two very different cases have to be distinguished from the point of view of operation, according to whether the feeding is effected at the upper patch or the lower patch (the one nearer the ground plane).

In the case where the feeding is obtained at the lower patch, this is most frequently a connection at the circumference of this patch. Moreover, provision is systematically made for an upper patch of a larger size than that of the lower patch (see in particular the article of TULINTSEFF, ALI & KONG, "Input impedance of a probe-fed stacked circular microstrip antenna") IEEE Transactions on Antennas and Propagation, Vol. 39 No. 3, March 1991).

The expert will know that the perfection of superposed patch antennas is particularly intricate. Attempts have been made to model their properties. By way of example, we will mention COCK & CHRISTODOULOU's "Design of a two-layer, capacitively coupled, microstrip patch antenna element for broad band applications", IEEE Symposium on antenna propagation, 1987. In spite of these attempts, it is still extremely difficult to predict by modelling, and to understand the behaviour of microstrip structures comprising two or more superposed patches.

The Applicants' assignees have set themselves the problem of obtaining a conformable antenna with electronic scanning, intended for the communication system with movable objects such as aircraft (the system called SATCOM).

This system is provided for operating with the group of geostationary satellites managed by the INMARSAT organisation. At least as far as the applications to aircraft are concerned, the proposed telecommunications service is governed by an international standard called ARINC 741.

Technically, one is concerned with setting up an antenna capable of operating, on the one hand, in the transmitting mode and, on the other hand, in the receiving mode, in two very close bands, that is to say, one a little higher than 1.5 gigahertz for receiving and another a little higher than 1.6 gigahertz for transmitting.

The electronic scanning function is necessary for this antenna because of the movement of the movable carrier which is here assumed to be an aircraft. It is also necessary to choose between a roof antenna or two lateral antennas. In the case of two lateral antennas, the above mentioned ARINC Standard has defined two official acceptable shapes defining the volume into which the planned antenna has to be fitted.

The antenna must also be conformable, that is to say, be capable of adapting to the exact wall-shape of the movable carrier. It must, moreover, be thin so as to minimize the aerodynamic drag and of course, be designed so as to comply with the required mechanical characteristics required for the structure of the aircraft.

During the research they have undertaken, the Applicants' assignees have found that it was possible to design a microstrip antenna going virtually against the solutions accepted so far by the experts.

OBJECT OF THE INVENTION

It is therefore an object of the present invention to provide an antenna element that is fundamentally different from those known so far.

It is a further object of the invention to provide an antenna element of the type comprising a first dielectric layer including on one side a ground plane and on the other a first conductive patch of a chosen shape, a second dielectric layer which surmounts the first layer on the side of the first patch and which supports on the other side opposite the first patch a second conductive patch of a chosen shape, a third dielectric layer surmounting the second, and also means for feeding ultra-high frequencies to one of the conductive patches.

SUMMARY OF THE INVENTION

According to the invention, the second patch is of a smaller size than that of the first patch and the electrical connection to this first patch is from below at at least one chosen point situated between its center and its circumference.

With this structure, it has proved possible to construct an operational antenna, subject to choosing the position of the connection point in question according to the respective sizes of the first and second patches, and according to the dielectric characteristics of the first and second dielectric layers, as well as those of the third dielectric layer which preferably has dielectric constants that are distinctly higher than those of the two others.

The first patch may be connected to a lead-in through the ground plane joining a feeding circuit implanted in a dielectric substrate of a three-plate-type structure. More particularly, the three-plate structure includes a substrate layer implanted between the above mentioned ground plane and a bottom ground plane; between the two ground planes, provision is made for conductive lead-ins defining a peripheral shield for the feeder part of the antenna element. Preferably, provision is made for a Wilkinson divider capable of feeding the lower patch at two points which together with its centre, form a substantially right-angled isosceles triangle, while the respective signals brought to these two points are in quadrature. The Wilkinson divider is implanted at an intermediate level of the substrate layer in accordance with the three-plate structure. This intermediate level serves in practice as the feeding distribution level between a central connector for the antenna as a whole and the various antenna elements which, in the application as an antenna array will constitute the antenna as a whole.

In an advantageous embodiment, the two patches have a generally circular shape and these two patches are substantially coaxial, that is to say, they are situated on the same perpendicular to the planes of the dielectric layers.

BRIEF DESCRIPTION OF THE DRAWINGS

Other objects and advantages of the invention will become apparent on examining the detailed description given below and the attached drawings wherein.

DETAILED DISCUSSION OF PREFERRED EMBODIMENTS

The expert will know that shape is important in microstrip devices. Moreover, the drawings are in essence of a definitive nature. They may therefore be incorporated in the description not only to render the latter more readily understood but also to contribute to the definition of the invention if required.

Figure 1:
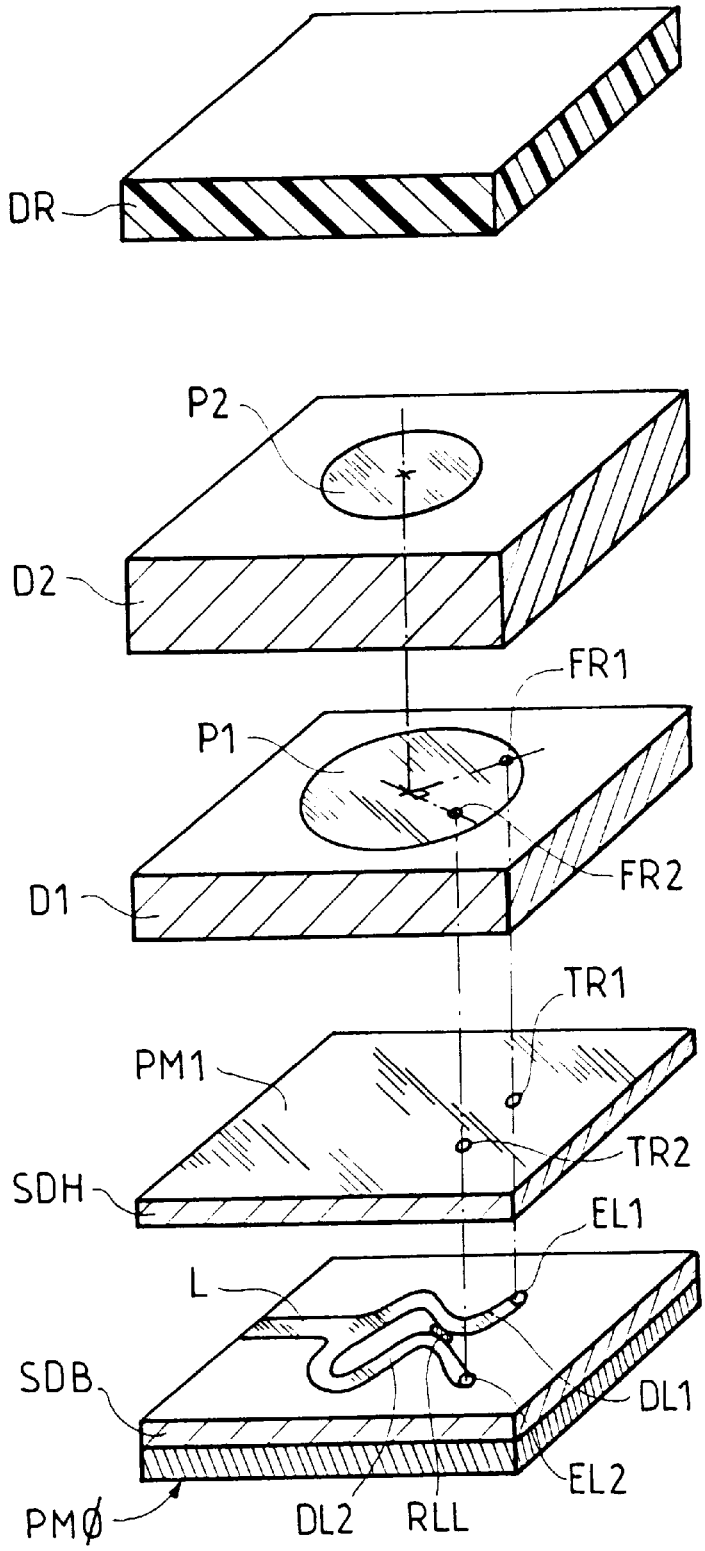
FIG. 1 is a general schematic diagram of an antenna element in an exploded perspective.
Figure 2:
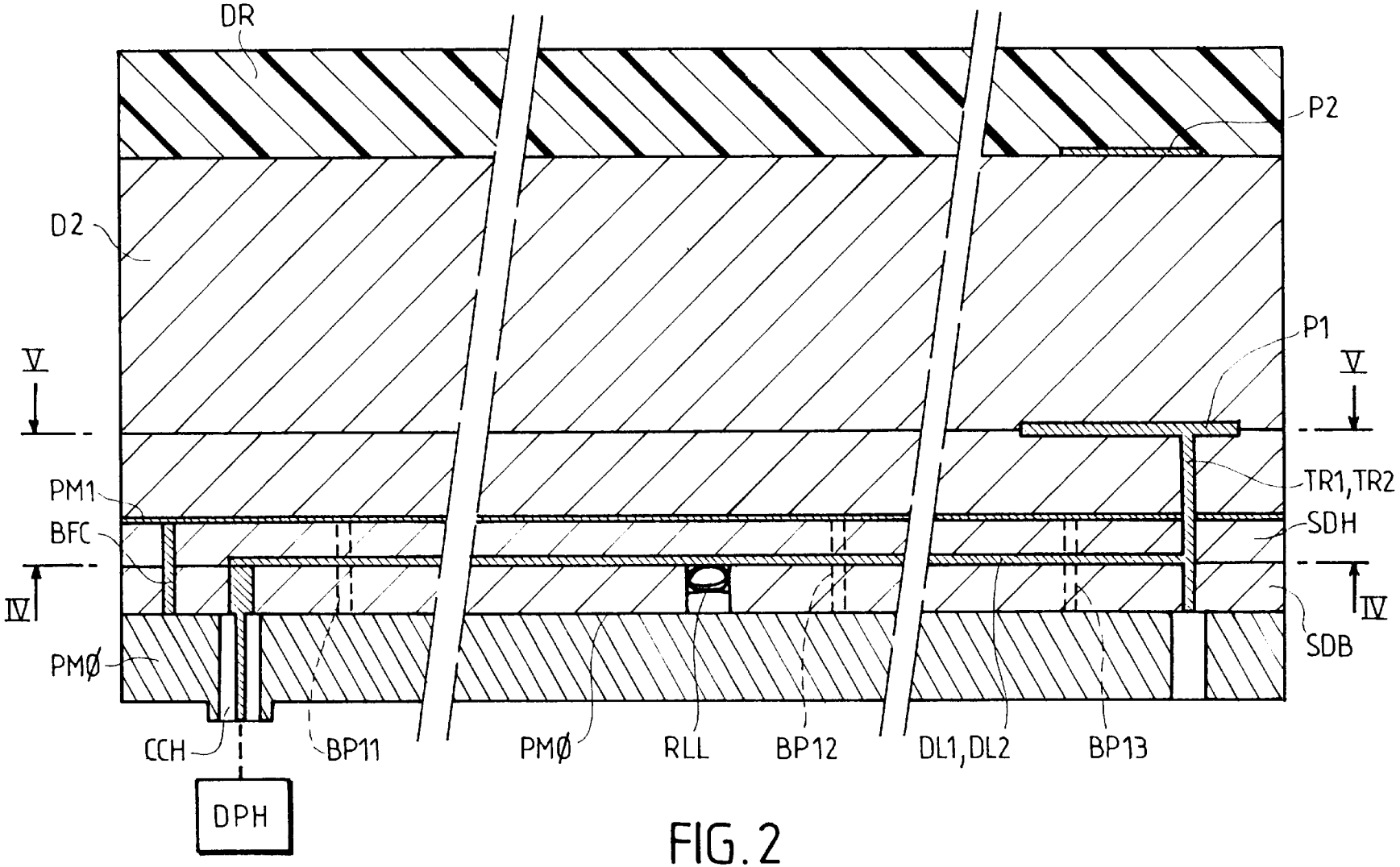
FIG. 2 is a broken partly sectioned view of an antenna element.

In FIGS. 1 and 2, the reference PMO designates a bottom ground plane which may be fitted by means of an insulating adhesive, on a sheet to be incorporated in the wall of the aircraft. This bottom ground plane is surmounted by two dielectric layers SDB and SDH (low and high respectively). The layer SDH is in turn surmounted by another ground plane PM1. The whole forms a three-plate structure with appropriate metallisations engraved between the layers SDB and SDH or more precisely, on one of these layers.

Fundamentally, these metallisations include a feeder line L which is subsequently subdivided in the manner of a Wilkinson divider, which is schematically outlined in FIG. 1 but is more clearly seen in FIGS. 3 and 4. This divider comprises two branches DL1 and DL2 which first diverge, to rejoin each other in a region where they are-connected to a resistor RLL implanted in the thickness of the layer SDB, but without rejoining the bottom ground plane PMO. Subsequently, the two branches DL1 and DL2 again diverge, to rejoin the respective connection points EL1 and EL2.

These points EL1 and EL2 are connected via lead-ins TR1 and TR2 (not connected to the ground plane PM1) to connection points FR1 and FR2 provided on the lower patch or control patch, P1 engraved on the top face of a dielectric layer D1 placed above the ground plane PM1.

Figure 3:
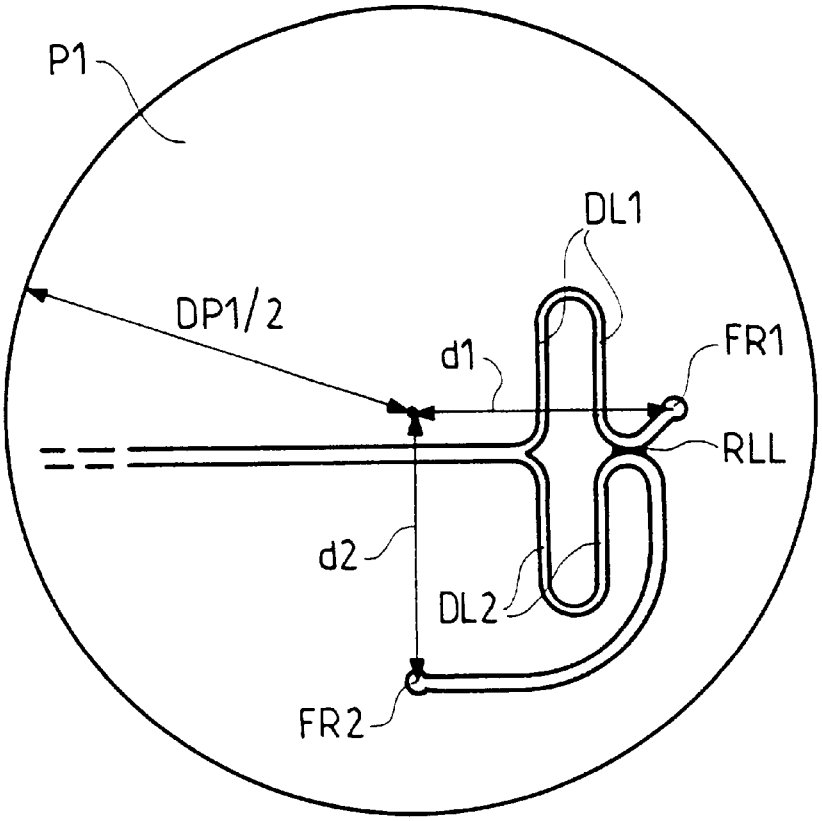
FIG. 3 is a (superposed) detailed part view of the connection of the lower patch to its feeding means by a Wilkinson divider.
Figure 4:
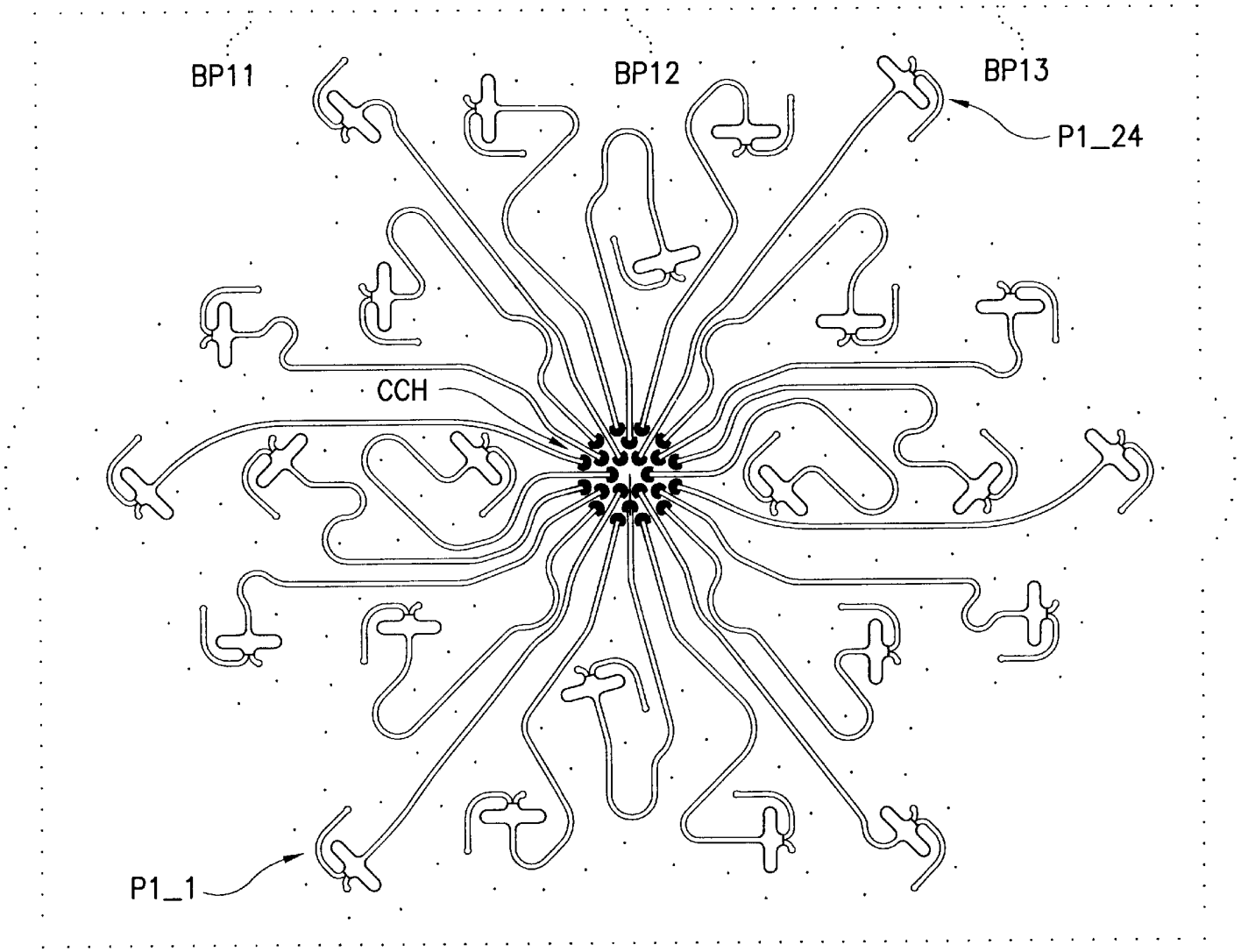
FIG. 4 is a view from below of the twenty four Wilkinson dividers, for a 24 element antenna, interconnected to the central connector.

As may be seen in FIGS. 3 and 4, the end portions of the engravings DL1 and DL2 have different lengths, so that electromagnetically, the signals available at the level of points FR1 are substantially in quadrature with each other. The connection points FR1 and FR2 of the patch P1 are situated on respective radii which are substantially at right angles to each other.

The distances d1 and d2 of these points from the centre of the patch P1 are in principle equal. The choice of these distances will be reverted to below. But it is possible to indicate forthwith that these distances d1 and d2 are in principle comprised between 50% and 100% of the radius of the patch P1 (designated DP1/2 in FIG. 3).

Above the patch P1, a second dielectric layer D2 is provided having the same dielectric constant as the layer D1 but having a greater thickness, as may be seen in FIG. 2. In the upper portion, the layer D2 receives by engraving a second conductive patch P2 (a coupled patch) which is generally circular and coaxial with the patch P1, but has a shorter diameter than that of the patch P1.

The antenna element is completed by an additional dielectric layer DR forming a radome and having in principle a dielectric constant that is distinctly higher than that of the layers D1 and D2.

In FIGS. 2 and 4, it will moreover be seen that the line L continues as far as a passage via a metallised hole to a generally coaxial-type ultra-high frequency connector CCH situated behind the metallic sheet subjacent to the bottom ground plane PMO.

Moreover, comparing FIGS. 2 and 4, it will be seen that this connector is provided for each contact stud with a horseshoe-shaped peripheral shield passing through the whole of the dielectric layer SDB. This shield could be defined by a continuous conductive layer. The Applicant has found that it was sufficient to make provision for a certain number of traversing studs surrounding the location of the lead-in CCH, with an interspacing between these studs which remains sufficiently shorter than the wave length of the ultra-high frequency signals processed.

Similarly, the peripheral studs such as BP11, BP12 and BP13 define a shield for the feeding of the antenna element in question, relative to the neighbouring antenna elements and with respect to the outside.

It will, however, be noted that above the ground plane PM1, no provision is made for any insulation of the antenna element relative to its neighbouring elements.

Figure 5:
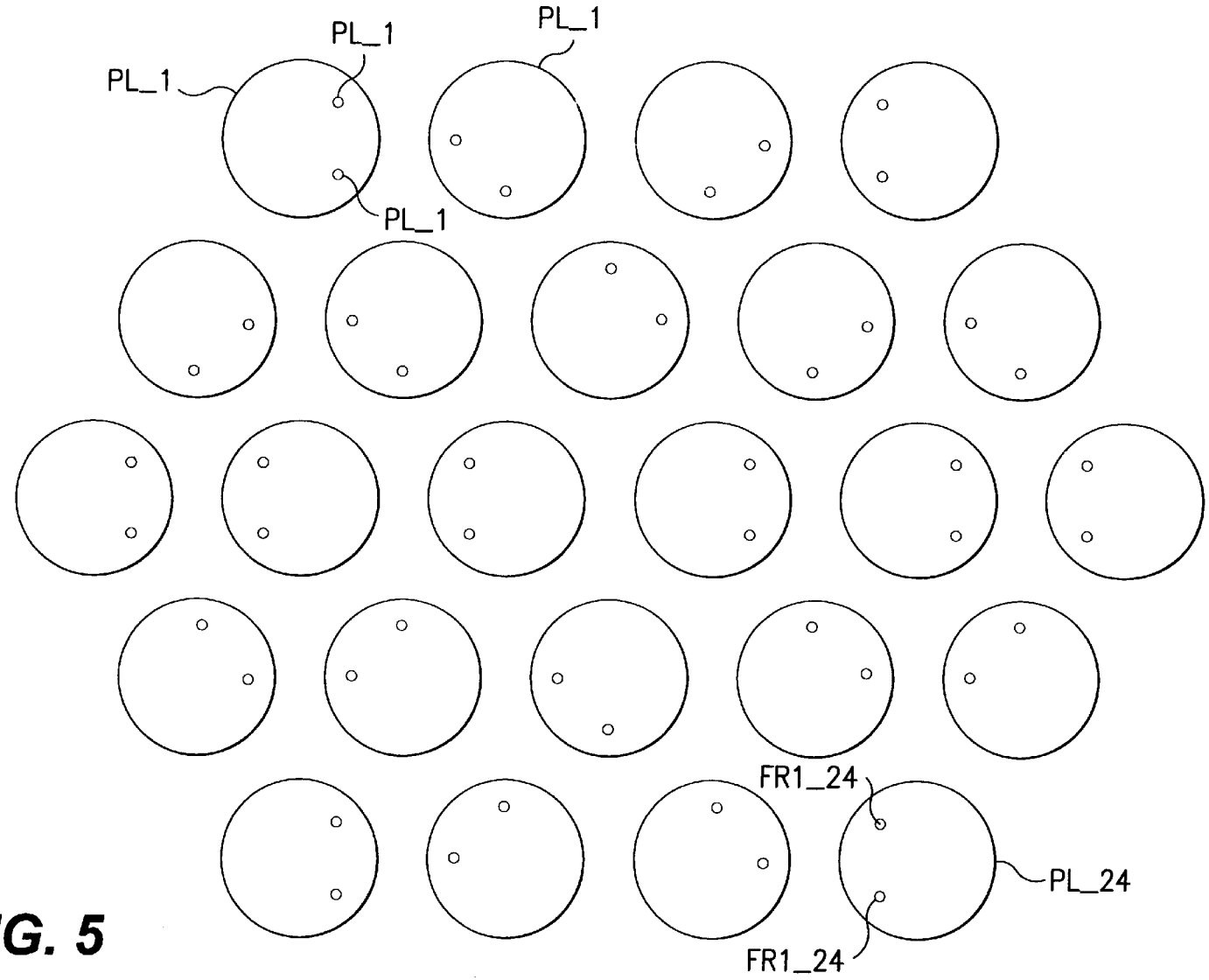
FIG. 5 is a top view of twenty four lower patches corresponding precisely to FIG. 4.

FIG. 5 shows how 24 antenna elements may be disposed to form a conformable antenna with electronic scanning, satisfying the conditions of the problem posed. As has already been indicated, these antenna elements are connected to a general connector with (at least) 24 pins. Up the line from this connector, provision is made for an individual reciprocal phase shift treatment for each antenna element by means of controllable phase shifters DPH schematically outlined in FIG. 2.

The main parameters affecting such an antenna are:

the height and the dielectric constant of the three layers DR, D2 and D1;

the diameters of the patches P1 and P2 and the radii d=d1=d2 of the two feeding points of the bottom patch P1.

Figure 6:
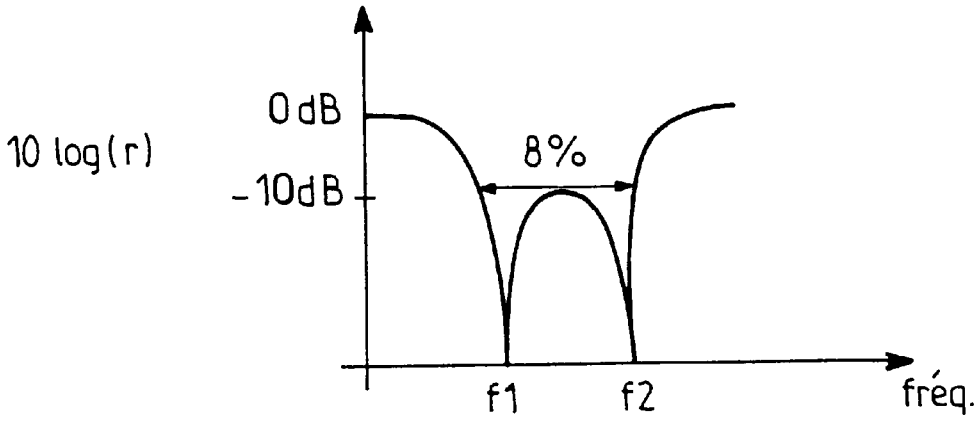
FIG. 6 is a diagram showing the reflection coefficient of the antenna in relation to the frequency.

The problem posed in the particular intended application is to obtain a dual behaviour from the unitary antenna element (FIG. 6) namely:

a) a dual frequency behaviour including a very good adaptation (better than −20 decibels) on two frequencies F1 and F2;

b) a broad band characteristic ensuring at least an adaptation of −10 decibels between the frequencies Fr and F4 containing the frequency interval of F1 and F2.

The applicant has observed that provided the frequencies F1 and F2 are not too remote from each other and, seeing that the parameters of the heights and dielectric constants of the above mentioned three layers are fixed, there exists in practice only one solution in terms of the radii of the two patches and of the feeding radius of the patch P1 which would make it possible to satisfy the conditions set out above.

Any modification of one of the parameters has the effect that it becomes very difficult to rediscover a situation capable of satisfying the conditions.

Although the phenomena in question have not yet been completely understood, it seems that in the general case, everything is taking place as though only one of the two patches P1 and P2 resonates at the operating frequency. On the other hand, there exists a very small domain in the parameters for the definition of the antenna, wherein the two patches are interacting while showing a typical dual frequency behaviour as desired. It is still necessary to search for the optimum point of this dual frequency behaviour to respond to the desired operating conditions for the antenna, such as those set out above.

In particular, it has been shown that in practice it is very difficult to cause the antenna element to function without adding thereto a top radome layer DR.

The Applicant has thus been able to obtain antennas responding to the following parameters:

thickness of the layer DR: 1.5 to 2.5 mm;

relative dielectric constant of the layer DR: from 4 to 5, and in a preferred embodiment, on the order of 4;

thickness of the layer D2: approximately 4.8 mm;

thickness of the layer D1: approximately 1.6 mm;

relative dielectric constants of the layers D1 and D2 as well as SDB and SDH: on the order of 2;

diameter of the patch P1: approximately 70 mm;

diameter of the patch P2: approximately 60 mm;

radius of the feeding points FR1 and FR2: from 0.5 to 0.7 times the radius of the patch P1.

Such antennas can satisfy the stipulated conditions for the SATCOM operating band, that is to say:

a reflection coefficient better than −20 dB at the central receiving frequency (1.545 GHz);

a reflection coefficient better than −20 dB at the central transmitting frequency (1.645 GHz);

where, the frequency of 1.545 GHz has a wavelength of 194 mm and the frequency of 1.645 GHz has a wavelength of 182 mm and the diameter of the first conductive patch is less than one half either of the wavelengths and, in a preferred embodiment, the diameter is between 36% and 38% of the wavelength;

a band pass characteristic at a level better than −10 dB between 1.53 and 1.66 GHz.

There will now be discussed the setting up of an array of antenna elements such as illustrated in FIGS. 4 and 5.

First of all, it has been indicated above that each bottom patch is fed at two points situated on respective radii which are substantially perpendicular to each other.

It has appeared worthwhile to distribute the two connection points in a suitable way and this in a different manner for the 24 antenna elements illustrated. The Applicants have found that this makes it possible to reduce the ellipticity (elliptical eccentricity) of the antenna, taking into account that it operates in the circular polarisation mode and with electronic scanning. For this purpose, it is possible either to distribute the connection points substantially at random or to search experimentally for an optimum configuration from the point of view of this ellipticity (for example, as in FIG. 5).

The thus obtained antenna array with electronic scanning has proved capable of operating with loss of aim (scatter) angles of up to 60°, with sufficiently low secondary lobe levels, and with a gain of at least 12 decibels as compared with an isotropic antenna.

A good compromise between the loss of gain and the secondary lobe level has been obtained by applying a slightly amplitude-weighted law of illumination. This may be a Taylor law of the circular 20 decibel type, these indications being comprehensible to the expert.

The phase shifters associated with each of the antenna elements may be integrated in the beam steering unit (or BSU) accommodated inside the aircraft.

Advantageously, line phase shifters are used that are switched by PIN diodes controlled by four bit binary words, whereby a resolution of 22.5° is obtained.

The distributor integrated in the phase shifter block ensures the amplitude weighting according to the above mentioned law.

In the particular intended application, the antenna must operate simultaneously in the transmitting and receiving modes at relatively close frequencies. As regards the calibration of the electronic scanning phase shifters, it is necessary to place the array in phase or to "phase" it over a band of approximately 8%.

Rather than calculate the phase code at the central frequency of the band, the Applicants have found that it was preferable to take into account the use of the two distinct frequencies, as well as the quantification and the nature of the phase shifters (switched lines). For this purpose, they use the calibration procedure described below.

Let an element Ai be taken of a conformable, hence non-planar, antenna, with coordinates (at the centre) Xi, Yi, Zi. When it is desired to displace the main beam into the direction U, V at the frequency f, it is necessary to apply to this antenna element Ai a theoretical phase shift DPi which is a function (known to the expert) of f, U and V:

$$DPi\ (f, U, V)$$

In practice, a calibration table TC (n, F) is used, where n is an integer (or another discrete variable) representing the required state of the phase shifter, with $0 \leqq n \leqq N$, while one also limits oneself to discrete values for the frequency F. This is written as:

$$DQi\ (F, n)$$

In the intended example, 101 frequency points are taken in the 1.53–1.66 GHz band; and N=15, with n defined in 4 bits. This method only "phases" the array correctly for a single frequency. Now the antenna essentially has a dual frequency behaviour.

The Applicant has then established a "distance" between the theoretical phase and the tabulated phase for the two frequencies f1 and f2, in particular in the form of:

$$DDi=|DQi\ (F1,n)-DPi\ (f1, U, V)|+|DQi\ (F2,n)-DPi\ (f2, U, V)|$$

where | designates the absolute value (modulus).

The calibration then lies in looking in respect of each aiming direction and each antenna element a priori for the value n which minimises this function DDi.

The actuation of the phase shifters is effected accordingly. This calibration can, of course, be stored.

The present invention is not necessarily limited to the embodiment described, nor to the application intended. The antenna element may itself be used for other applications provided the new structure is retained. The combination of a microstrip element and a three-plate feeding arrangement in the same dielectric stack also merits consideration.

The polarisation may be other than the circular polarisation of the embodiment described.

Another particular feature of the invention is that it can avoid, as far as the layers D1 and D2 are concerned, recourse to dielectrics with a low constant, or porous dielectrics or even those constituted by a gas.

We claim:

1. A UHF antenna device, intended to have radiation properties over an antenna bandwidth, said antenna device comprising:

first and second dielectric layer means overlying each other;

a first ground plane lying on said first dielectric layer means, opposed to said second dielectric layer means;

a first conductive patch of a chosen shape, located between said first and second dielectric layer means;

a second conductive patch of a chosen shape, lying on said second dielectric layer means, opposed to said first conductive patch, said first and second conductive patches substantially facing each other;

third dielectric layer means overlying both said second conductive patch and said second dielectric layer means, opposed to said first layer means; and coupling means for coupling ultra-high frequency electromagnetic wave energy to said first conductive patch, said first conductive patch in turn feeding said second conductive patch;

said coupling means comprising connection means to a chosen point of said first conductive patch, said connection means insulatively passing through said first ground plane and through said first dielectric layer means;

wherein:

said second conductive patch is of a size smaller than that of the first conductive patch;

said connection means of said coupling means being arranged for connection to at least one chosen point situated between the center and the circumference of said first conductive patch;

said chosen shapes of said first and second conductive patches and said at least one chosen point being selected together such that said first conductive patch contributes to the antenna radiation properties over a portion of said antenna bandwidth.

2. A device according to claim 1, wherein said first and second conductive patches are of a generally circular shape.

3. A device according to claim 1, wherein the dielectric materials of said first and second dielectric layer means have a dielectric constant of the order of 2, and wherein the ratio of the thicknesses of the second and first dielectric layer means is of the order of 3.

4. A device according to claim 3, wherein the dielectric material of said third dielectric layer means has a dielectric constant of the order of 4.

5. A device according to claim 1, further comprising fourth dielectric layer means underlying said first ground plane, opposed to said first dielectric layer means, and a second ground plane underlying said fourth dielectric layer means, opposed to said first ground plane.

6. A device according to claim 5, wherein said coupling means comprises a Wilkinson divider located at an intermediate level of said fourth dielectric layer means, and connected to said connector means for feeding said first conductive patch at two chosen points forming with said center of said first conductive patch a substantially right-angled isosceles triangle.

7. A device according to claim 5, wherein the dielectric material of said fourth dielectric layer means has a dielectric constant of the order of 2.

8. A device according to claim 5, further comprising transversal conductive lead-ins to connect said first ground plane to said second ground plane, said transversal conductive lead-ins defining a peripheral shield for said fourth dielectric layer means.

9. A UHF antenna device, intended to have radiation properties over an antenna bandwidth, said antenna device comprising:

first and second dielectric layer means overlying each other;

a first ground plane lying on said first dielectric layer means, opposed to said second dielectric layer means;

a first conductive patch of a generally circular shape, located between said first and second dielectric layer means;

a second conductive path of a generally circular shape, lying on said second dielectric layer means, opposed to said first conductive patch, said first and second conductive patches substantially facing each other, and said second conductive patch having a size smaller than that of the first conductive patch;

third dielectric layer means overlying both said second conductive patch and said second dielectric layer means, opposed to said first layer means;

fourth dielectric layer means underlying said first ground plane, opposed to said first dielectric layer means; and a second ground plane underlying said fourth dielectric layer means, opposed to said first ground plane;

coupling means comprising a feeding circuit located intermediate level said fourth dielectric layer means and said first ground plane; and connecting means for connecting said feeding circuit to at least one chosen point situated between the center and the circumference of said first conductive patch, said connecting means insulatively passing through said first ground plane and through said first dielectric layer means;

said first and second ground planes forming with said coupling means and said fourth dielectric layer means a three-plate structure.

10. A device according to claim 9, wherein said feeding circuit comprises a Wilkinson divider connected to said connector means for feeding said first conductive patch at two chosen points situated between the center and the circumference of said first conductive patch and forming with said center of said first conductive patch a substantially right-angled isosceles triangle.

11. A device according to claim 9, wherein the dielectric materials of said first and second dielectric layer means and of said fourth dielectric layer means have a dielectric constant of the order of 2, and wherein the ratio of the thicknesses of the second and first dielectric layer means is of the order of 3.

12. A device according to claim 11, wherein the dielectric material of said third dielectric layer means has a dielectric constant of the order of 4.

13. An UHF antenna array device, intended to have radiation properties over an antenna bandwidth, said antenna array device comprising:

first and second dielectric layer means overlying each other;

a first ground plane lying on said first dielectric layer means, opposed to said second dielectric layer means;

a plurality of first conductive patches of a chosen shape, located between said first and second dielectric layer means;

a plurality of second conducive patches of a chosen shape, lying on said second dielectric layer means, each of said second conductive patches being opposed and coaxial to a respective one of said first conducive patches;

third dielectric layer means overlying both said second conductive patches and said second dielectric layer means, opposed to said first layer means; and coupling means for coupling ultra-high frequency electromagnetic wave energy to each of said first conductive patches, each of said first conductive patches in turn feeding a respective one of said second conductive patches;

said coupling means comprising connection means to a chosen point of each of said first conductive patches, said connection means insulatively passing through said first ground plane and through said first dielectric layer means;

wherein:

each of said second conductive patches is of a size smaller than that of the first conductive patch that is coaxial to it;

said connection means of said coupling means being arranged for connection to at least one chosen point situated between the center and the circumference of each said first conductive patches;

said chosen shapes of said first and second conductive patches and said at least one chosen point being selected together such that said first conductive patches contributes to the antenna radiation properties over a portion of said antenna bandwidth.

14. A device according to claim 13, wherein said first and second conductive patches are of a generally circular shape.

15. A device according to claim 13, wherein the dielectric materials of said first and second dielectric layer means have a dielectric constant of the order of 2, and wherein the ratio of the thicknesses of the second and first dielectric layer means is of the order of 3.

16. A device according to claim 15, wherein the dielectric material of said third dielectric layer means has a dielectric constant of the order of 4.

17. A device according to claim 13, further comprising fourth dielectric layer means underlying said first ground plane, opposed to said first dielectric layer means, and a second ground plane underlying said fourth dielectric layer means, opposed to said first ground plane.

18. A device according to claim 17, wherein the dielectric material of said fourth dielectric layer means has a dielectric constant of the order of 2.

19. A device according to claim 17, wherein said coupling means comprises a Wilkinson divider located at an intermediate level of said fourth dielectric layer means, and connected to said connector means for feeding each of said first conductive patches at two chosen points forming with said center of said first conductive patch a substantially right-angled isosceles triangle.

20. A device according to claim 19, wherein said pairs of chosen points on each respective first patches are distributed according to a predetermined configuration to improve the ellipticity rate of the antenna array device for large beam steering angles.

21. A device according to claim 20, wherein said predetermined configuration is of a substantially random distribution type or experimentally determined type.

22. A device according to claim 17, further comprising transversal peripheral conductive lead-ins to connect said first ground plane to said second ground plane, said transversal conductive lead-ins defining a peripheral shield for said fourth dielectric layer means.

23. A device according to claim 13, wherein said coupling means is fed with controllable phase shifters imparting thereto an electronic scanning function.

24. A device according to claim 23, wherein said controllable phase shifters are calibrated on the basis of a function of the distance between the theoretical and real values for both respective ones of two central working frequencies of the antenna.

25. An antenna device for atmospheric propagation of an ultra high frequency (UHF) electromagnetic energy signal, said signal having a wavelength, said antenna device comprising:

first dielectric layer means having first and second opposing sides;

a ground plane on said fist side;

a first conductive patch of a chosen shape on said second side of said first dielectric layer means, said first conductive patch having a first side adjacent first dielectric layer means and a second side;

second dielectric layer means, having first and second sides, surmounting said first dielectric layer means with said first dielectric layer means second side adjacent said first side of the second dielectric layer means, said first patch second side adjacent said second dielectric layer means first side;

a second conductive patch of a chosen shape, on said second dielectric layer means second side;

third dielectric layer means surmounting the second dielectric layer means; and connector means for connecting said UHF signal to one of said conductive patches, wherein:

(a) said second conductive patch is of a size smaller than that of the first conductive patch;

(b) said first conductive patch first side is connected to said connector means at at least one chosen point situated between the center and the circumference of said first conductive patch.

26. An antenna device according to claim 25, wherein said first conductive patch has a diameter less than ½ said wavelength.

27. An antenna device according to claim 25, wherein said first and second dielectric layer means are each comprised of a material having a dielectric constant on the order of 2, and each have a thickness wherein a ratio of thickness of the second dielectric layer means to the first dielectric layer means is on the order of 3.

28. An antenna device according to claim 27, wherein said third dielectric layer means is comprised of a material having a dielectric constant on the order of 4.

29. An antenna device according to claim 25, wherein said connector means includes a feeding circuit in a dielectric substrate, said dielectric substrate comprised of a three-plate structure, and further including a bottom ground plate below said dielectric substrate, said three plate structure including a substrate layer located between said ground plane and said bottom ground plane, said substrate layer having conductive lead-ins defining a peripheral shield and a Wilkinson divider, said conductive lead-ins, in combination with said connector means, comprising a means for feeding said first conductive patch at two separated points, said separated points in combination with a center of said first conductive patch forming a substantially right-angled isosceles triangle.

30. An antenna device according to claim 25, wherein said antenna device has a reflection coefficient better than −20 dB a central receiving frequency of 1.545 GHz and a central transmitting frequency of 1.645 GHz, said first conductive patch has a diameter of about 70 mm and said second conductive patch has a diameter of about 60 mm.

31. An antenna device according to claim 25, wherein said first conductive patch has a diameter of from about 36% to about 38% of said wavelength.

* * * * *